US006092648A

United States Patent [19]

Sellars

[11] Patent Number: 6,092,648

[45] Date of Patent: Jul. 25, 2000

[54] STORAGE, ADMIXING, AND DISPENSING SYSTEM

[76] Inventor: Andy Sellars, 4834 E. Hannibal Cir., Mesa, Ariz. 85205

[21] Appl. No.: 09/360,811

[22] Filed: Jul. 26, 1999

Related U.S. Application Data

[62] Division of application No. 09/075,161, May 8, 1998, Pat. No. 5,950,819.

[51] Int. Cl.[7] ..... B65D 25/08

[52] U.S. Cl. ..... 206/221; 215/DIG. 8

[58] Field of Search ..... 206/219–222, 206/583; 215/3, 6, DIG. 8; 222/80; 426/82

[56] References Cited

U.S. PATENT DOCUMENTS

| | | | |
|---|---|---|---|
| 2,615,448 | 10/1952 | Fields | 206/221 |
| 3,156,369 | 11/1964 | Boews et al. | 215/DIG. 8 |
| 5,335,773 | 8/1994 | Haber et al. | 206/221 |
| 5,593,028 | 1/1997 | Haber et al. | 206/221 |
| 5,811,060 | 9/1998 | Laguna Valderrama | 206/222 |

*Primary Examiner*—Paul T. Sewell
*Assistant Examiner*—Luan K. Bui
*Attorney, Agent, or Firm*—Harry M. Weiss; Jeffrey Weiss; Paul W. Davis

[57] ABSTRACT

A storage, admixing, and dispensing system is shown. The storage, admixing, and dispensing system has a first vessel for retaining a first substance. A support structure is coupled to and seals the first vessel, and a second vessel is coupled to the support structure for containing a second substance. A release mechanism is coupled to the support structure for releasing the second vessel from the support structure for combining the first substance with the second substance. The second vessel is internal to and retained within the first vessel. The release mechanism comprises a resilient material pushbutton which also seals the second vessel. The second vessel is also an agitator for combining the first substance and the second substance. Additionally, the first vessel is a dispensing apparatus for dispensing the admixture. Further included is a safety mechanism coupled to the resilient material pushbutton for preventing accidental operation of the release mechanism.

19 Claims, 2 Drawing Sheets

STORAGE, ADMIXING, AND DISPENSING SYSTEM

This application is a divisional patent application of Ser. No. 09/075,161, filed May 8, 1998 entitled "STORAGE, ADMIXING, AND DISPENSING SYSTEM", U.S. Pat. No. 5,950,819. The contents of that parent patent application are incorporated herein by reference.

BACKGROUND OF THE INVENTION

1. Field of the Invention

This invention is in the field of systems for storage, admixing, and dispensing fluids, and more particularly, to a system comprising a first hermetically sealed vessel for retaining a first substance, a second hermetically sealed vessel for containing a second substance internal to the first vessel, and a release mechanism for releasing the second vessel into the first vessel and mixing the substances contained within.

2. Description of the Related Art

Systems for the storage of two separate substances with provision made for the combining and mixing thereof have been known and used for many years. These systems range from side by side chambers such as is used for dispensing and mixing epoxy type glues, to systems where a small chamber resides within a second larger chamber and the user can release one chamber into the second chamber. Systems of this type are useful for providing exact additions of materials in a pre-determined ration, for delaying the mixing of the substances until desired where the materials have a short useful life once mixed, and isolating the materials from the atmosphere or contact with the user until mixed.

These systems have several short comings however. Some of these problems are that the systems are designed only for use by professionals within a professional field such as medicine. Furthermore, many of these systems require the use of external non-included equipment such as a hypodermic needle and syringe. Another problem with many of these systems is that they have no provision for mixing the separate materials together adequately. Finally, most systems lack any provision for detecting or preventing tampering with the containers, or any indication that the system has been operated and the contents of the separate containers have been combined with each other.

Therefore, there exist a need to provide an improved storing, admixing and dispersing apparatus. The improved apparatus must be an inexpensive, and user-friendly system for storing separate substances in hermetic isolation between each other and the atmosphere in order to preserve or prolong their usefulness. The improved apparatus must have usage indication or tamper proofing safety features such that the user would be able to ascertain that the system has not been tampered with or used accidentally. The improved apparatus must be very easily manufactured using existing manufacturing systems, equipment and currently manufactured containers for the main vessel or container.

SUMMARY OF THE INVENTION

An object of the present invention is to provide an improved storing, admixing and dispensing apparatus.

Another object of the present invention is to provide an inexpensive, and user-friendly system for storing separate substances in hermetic isolation between each other and the atmosphere in order to preserve or prolong their usefulness.

Another object of the present invention is to provide an improved apparatus having usage indication or tamper proofing safety features such that the user would be able to ascertain that the system has not been tampered with or used accidentally.

Still yet another object of the present invention is to provide an improved apparatus that is very easily manufactured using existing manufacturing systems, equipment and currently manufactured containers for the main vessel or container.

BRIEF DESCRIPTION OF THE PREFERRED EMBODIMENTS

In accordance with one embodiment of the present invention, a storage, admixing, and dispensing system is disclosed. The storage, admixing, and dispensing system comprises: a first vessel for retaining a first substance, a support structure coupled to the first vessel, a second vessel coupled to the support structure for containing a second substance, a release mechanism coupled to the support structure for releasing the second vessel from the support structure for combining the first substance with the second substance, and a safety mechanism coupled to the resilient material pushbutton for preventing accidental operation of the release mechanism. The second vessel is internal to and retained within the first vessel. The release mechanism completely releases the second vessel from the support structure for combining the first substance with the second substance. The release mechanism comprises a resilient material pushbutton. The safety mechanism comprises: a hinged protective cover; a protruding snap cap coupled to the hinged protective cover; a indent coupled to the protruding snap cap; a protruding ridge coupled to the indent when in a closed position. The hinged protective cover has an open position and a closed position. The open position exposes the resilient material pushbutton for allowing the depression of the resilient material pushbutton for activating the release mechanism and the closed position covers the resilient material pushbutton for preventing depression thereof.

In accordance with another embodiment of the present invention, a storage, admixing, and dispensing system is disclosed. The storage, admixing, and dispensing system comprises: a first vessel for retaining a first substance wherein the first vessel is a dispensing apparatus for dispensing the admixture; and a support structure coupled to the first vessel wherein the first vessel is a box container, and the support structure is bonded to the first vessel; a second vessel coupled to the support structure for containing a second substance and wherein the second vessel is internal to and retained within the first vessel and is an agitator for combining the first substance and the second substance within the first vessel, the first substance and the second substance form a admixture when combined; and a release mechanism coupled to the support structure for releasing the second vessel from the support structure for combining the first substance with the second substance. The release mechanism comprises: a resilient material pushbutton which seals the second vessel; and a safety mechanism coupled to the support structure for preventing accidental operation of the release mechanism. The safety mechanism has an open position and a closed position wherein the open position exposes the resilient material pushbutton for allowing the depression of the resilient material pushbutton for activating the release mechanism and the closed position covers the resilient material pushbutton for preventing depression thereof. The system is further comprised of: a frangible annular ring membrane coupled to the second vessel for coupling the support structure to the second vessel wherein the frangible annular ring membrane is a hermetic seal between the first vessel and the second vessel; a plurality of ribs located on an edge of the second vessel for aiding in the tearing of the annular ring membrane upon the depression of the resilient material pushbutton; and a straw sized opening formed within the resilient material pushbutton and wherein the straw sized opening has a frangible membrane for sealing the straw sized opening and which is penetrable by a drinking straw for allowing the admixture to be dispensed.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Bottle Embodiment

Figure 1:
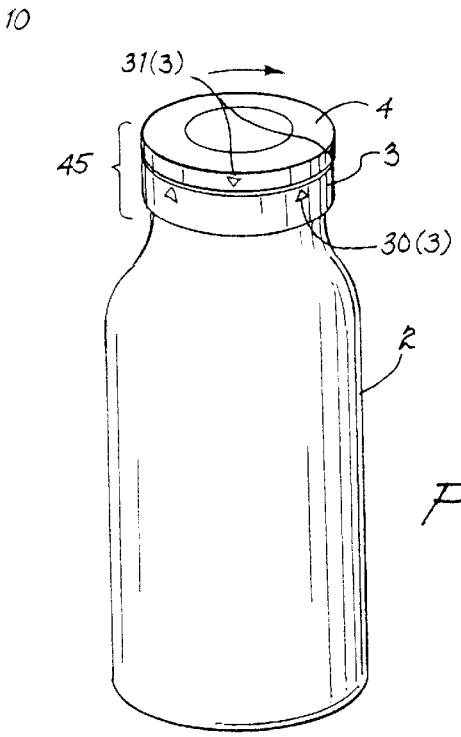
FIG. 1 shows a perspective view of the Storage, Admixing, and Dispensing System featuring the embodiment in which the container and support structure are a bottle and screw type engagement bottle cap.

Referring to Fig. 1, a simplified perspective view of the Storage, Admixing, and Dispensing System 10 (hereinafter the "system 10"), featuring the embodiment in which the cap assembly and container form a bottle and screw type engagement bottle cap assembly is shown. The system 10 comprises a bottle 2 to which is coupled a cap assembly 45 consisting of two pieces snap-fitted together. Visible in FIG. 1, the bottle 2 is shown with the cap assembly 45 sealing the top of the bottle 2. The cap assembly 45 comprises a structural support 3 to which is coupled a resilient material pushbutton 4. Both of these items may be manufactured from aluminum, polyethylene, polypropylene, or other plastics or materials of appropriate structural strength and flexiblity. The bottle 2 may be filled with any desired material or fluid substance, through liquid is used and described in the present embodiment of the system 10.

The bottle embodiment of the present invention features a safety mechanism to prevent accidental operation during shipping and handling. Shown in FIG. 1 are the external indicia of the safety mechanism consisting of three embossed arrows 31 on the resilient material pushbutton 4, and three embossed arrows 30 on the support structure 3.

Figure 2:
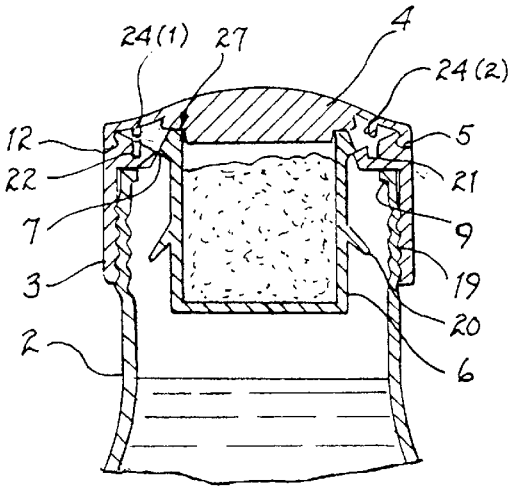
FIG. 2 shows a cross-sectional view of the support structure used with the bottle container embodiment, specifically featuring the second vessel and release mechanism prior to operation or use.

Referring to FIG. 2, a simplified cross-sectional view of the support structure 3 used with the bottle container embodiment, specifically featuring the bottle 2 and resilient material pushbutton 4 prior to operation of the system 10 is shown. The support structure 3 and the bottle 2 have screw type threading 19 upon the inner surface of the support structure 3, and the outer neck surface of the bottle 2. This crew type threading is well known to those skilled in the art of bottles and their closures. Embedded on the underside of the resilient material pushbutton 4 is an elastomeric seal 27 that forms a hermetic seal against the upper edge of rim of the second vessel 6 when the resilient material pushbutton 4 is fitted to the support structure 3.

Figure 4:
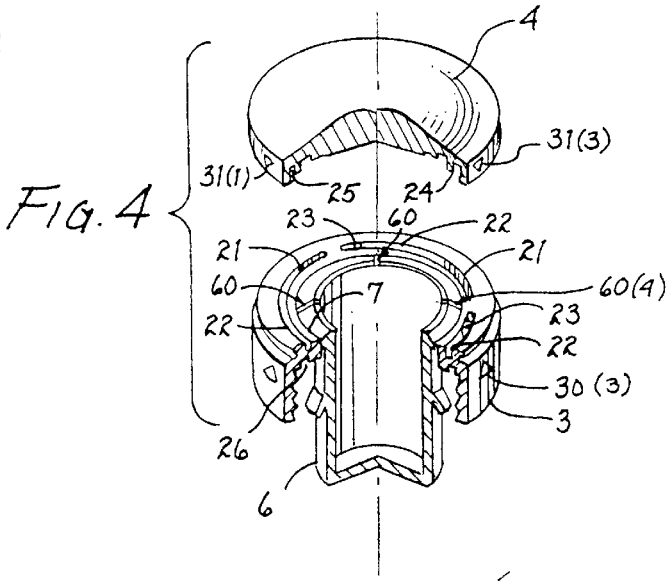
FIG. 4 shows a exploded view of the support structure, safety mechanism and pushbutton used with the bottle embodiment.

Referring to both FIG. 2 and FIG. 4, the resilient material pushbutton 4 includes three tangs 24, each of a 60 degree arc length upon the underside of the resilient material pushbutton 4. The tangs 24 rest in three corresponding shallow grooves 22 that are molded into the upper surface of the support structure 3. The three tangs 24 are in physical contact with the shallow grooves 22. This physical contact will prevent the depressing of the resilient material pushbutton 4. Offset from the shallow grooves 22 by 60 degrees are a set of three deep notches 21 formed in the upper surface of the support structure 3. Those well skilled in the art will recognize that depending on the number and dimensions of the tangs and notches desired, the angle of offset between the notches and the degree of rotation may vary. The deep notches 21 are sufficiently deep so that when positioned correctly, the tangs 24 may be completely inserted into the deep notches 21. The external indicia consisting of three embossed arrows 31 on the resilient material pushbutton 4, and three embossed arrows 30 on the support structure 3 when aligned pointing at each other will indicate that the tangs 24 are positioned over the deep notches 21.

The support structure 3 is coupled to a second container or vessel, (hereinafter "second vessel") which is internal to, though hermetically isolated from, the bottle 2 (when the support structure 3 is coupled to the bottle 2). The second vessel 6 of the support structure 3 is filled with the desired material or fluid substance. In the present bottle embodiment a dry powder is used and described. Following the filling of the second vessel 6 with the dry powder, the resilient material pushbutton 4 is snap-fitted to the support structure 3. The snap fit is accomplished by an annular ridge 5 molded on the underside of the inside lip surface of the resilient material pushbutton 4. The annular ridge 5 will snap into a corresponding annular recess 12 molded upon on the outer perimeter of the raised portion of the support structure 3. The snap fit coupling between the annular ridge 5 and the annular recess 12 forms a seal to retain and hermetically seal the dry powder into the second vessel 6. The support structure 3 and second vessel 6 are a single molded part wherein the second vessel 6 is attached to the support structure 3 by a paper-thin annular membrane ring 7 designed to be easily torn or separated to release the second vessel 6 into the material or liquid within the bottle 2.

The second vessel 6 also comprises a thin flexible annular flange 20 that circumscribes the outside circumference of the second vessel 6. The outside diameter of the flexible annular flange 20 is of a slightly greater diameter than the bottle opening 9 diameter. The flexible annular flange 20 protrudes at an angle toward the base or bottom of the second vessel 6 purely as a matter of increasing the ease of manufacturability with existing industrial equipment. The flexible annular flange 20 could also protrude out at an angle perpendicular to the second vessel 6 or have other angles or dimensions as long as the goal of preventing the second vessel 6 from flowing out the neck of the bottle 2 is met.

Referring to FIG. 4 a simplified exploded view of the support structure, safety mechanism and pushbutton used with the bottle embodiment is shown. The bottom surface of each of the shallow grooves 22 of the support structure 3 includes a retainer ridge 23 that forms a friction fit against a retainer recess 25 that is formed as part of the underside surface of each tang 24 of the resilient material pushbutton 4. Those well skilled in the art will recognize that the retainer ridge(s) could be placed on the inside or outside wall surface of the shallow grooves 22, and the retainer recess(s) could be placed on the inside or outside surface of the tang(s) 24 and the same desired function achieved. The friction fit is to resist the inadvertent rotation of the resilient material pushbutton 4 during shipping and handling thus maintaining the tangs 24 positioned over the shallow grooves 22.

Embedded on the underside of the support structure 3 above the screw type threading 19 is an annular elastomeric seal 26 to establish a seal between the upper edge of the neck of the bottle 2, and the underside of the support structure 3.

Formed upon the upper surface of the edge of the second vessel 6 are a plurality of ribs 60, (four ribs in the present embodiment). The ribs 60 rise above the surface of the edge of the second vessel 6 with the ends of the ribs 60 meeting the edge of the annular membrane ring 7 at a perpendicular angle. The ribs 60 function to cause stress or fracture points on the annular membrane ring 7 when the resilient material pushbutton 4 contacts and exerts force upon the plurality of ribs 60.

Figure 3:
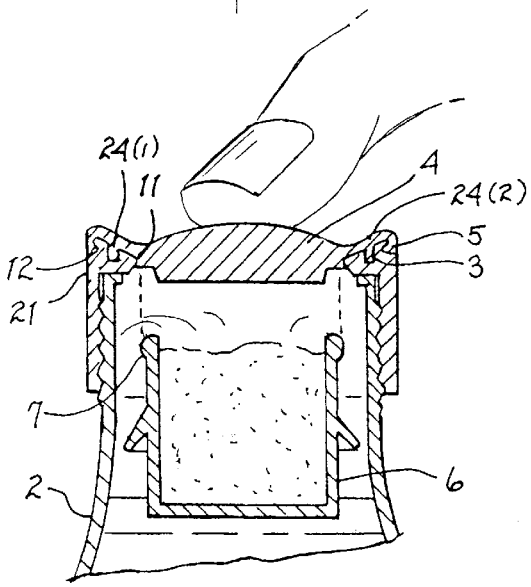
FIG. 3 shows a cross-sectional view of the support structure used with the bottle container embodiment, specifically featuring the second vessel and release mechanism after the release mechanism has been operated.

Referring to FIG. 3, a simplified cross-sectional view of the support structure used with the bottle container embodiment is shown. This figure illustrates the second vessel and resilient material pushbutton 4 after the resilient material pushbutton 4 has been depressed for the operation of the present embodiment. The resilient material pushbutton 4 includes an annular snap ring 11 formed as part of the resilient material pushbutton 4. The annular snap ring 11 is sized to engage and lock into the orifice created when the annular membrane ring 7 fractures and separates allowing the second vessel 6 to be released into the bottle 2. The annular snap ring 11 will engage and lock into the orifice and forms a seal at the annular membrane ring 7 fracture boundary. The seal formed when the annular snap ring 11 locks into the orifice created within the annular membrane ring 7 creates a second seal in the path leading along the resilient material pushbutton 4 from the interior of the bottle 2 to the exterior of the bottle 2. The first seal is created between the annular ridge 5 molded on the underside of the inside lip surface of the resilient material pushbutton 4 and the corresponding annular recess 12 molded upon the outer perimeter of the raised portion of the support structure 3.

The second vessel 6 after its release from the annular membrane ring 7 moves into the main body of the bottle 2 and the contents of bottle 2 and the second vessel 6 are free to combine. The second vessel 6 also serves as an agitator to assist in the complete admixing of the different substances. In the present embodiment the two substances are a dry powder and a liquid, though those skilled in the art will recognize that many combinations of powders and/or fluids could be placed in the bottle and second vessel and then admixed.

Figure 5:
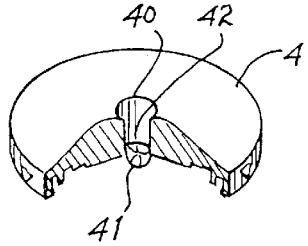
FIG. 5 shows a third embodiment of the Storage, Admixing, and Dispensing System in which the pushbutton incorporates a straw access through a thin frangible membrane.

Referring to Fig. 5, an alternate embodiment of the resilient material pushbutton 4 of the system 10 is shown. In this embodiment the resilient material pushbutton 4 incorporates a straw access 40 through the resilient material pushbutton 4. The straw access 40 is covered by a thin frangible membrane 41 coupled to the bottom end of the straw access 40. The frangible membrane 41 has grooved tear lines 42 in a cross-hair pattern that may be fractured by a standard drinking straw inserted into the straw access 40.

Box Container Embodiment (It should be noted that the two embodiments use similar numbering for the similar elements used in both the bottle and the box container embodiments. To differentiate between the embodiments, the box container embodiment numbers include an accent character following the number. e.g. 100 becomes 100'.)

Figure 6:
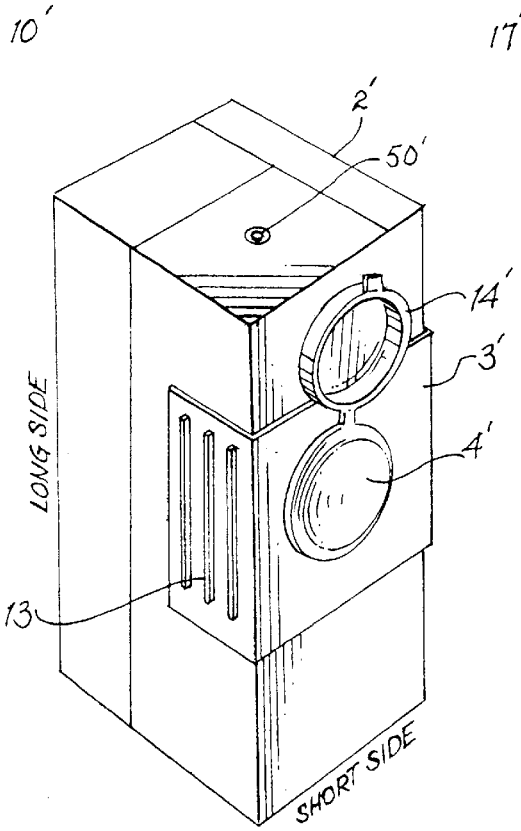
FIG. 6 shows a perspective view of the Storage, Admixing, and Dispensing System featuring the embodiment in which the support structure is bonded to a box container.

Referring to FIG. 6, a simplified perspective view of the Storage, Admixing, and Dispensing System 10' is shown (hereinafter the "system 10'), featuring the embodiment in which the support structure 3' is bonded to a box container 2'. The system 10' comprises a box container 2' to which is coupled the support structure 3'. The structural support 3' is a formed or molded "C" shaped unit coupled or bonded to the side of the box container 2' resulting in an integrated unit. The box container 2' is a box style drinking container as is well known in the art of drinking of fluid containers and dispensers. One surface of the box container 2' has a drinking straw hole 50' placed upon it in a manner well known to those skilled in the art. The structural support 3' also comprises a resilient material pushbutton 4' coupled to it. The support structure 3', the resilient material pushbutton 4', and the box container 2' may be manufactured from aluminum, polyethylene, polypropylene, or other plastics or materials of appropriate structural strength and flexibility. The box container 2' may be filled with any desired material or fluid substance, though liquid is used and described in the present embodiment of the system 10'. The structural support 3' has two ribbed structural enhanced sides 13', formed into the support structure 3 on the sides that straddle the box container 2' which provide a gripping surface for grasping the system 10'.

A hinged protective cover 14' is molded as an integral part of the resilient material pushbutton 4' and snaps closed for shipping and handling protection. While in the closed position the resilient material pushbutton 4' cannot be accidentally depressed during shipping or handling.

Figure 7:
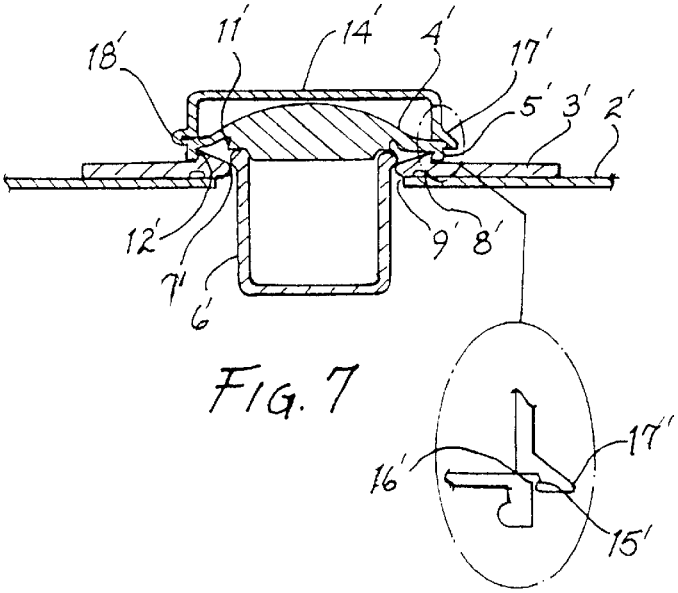
FIG. 7 shows a long-side cross-sectional view of the support structure used with the box container embodiment, featuring the second vessel and release mechanism prior to operation or use.

Referring to FIG. 7 a simplified long-side cross-sectional view of the support structure 3' used with the box container 2' embodiment, featuring the second vessel 6', the hinged protective cover 14' and resilient material pushbutton 4' prior to operation or use the shown. The hinged protective covered 14' is closed in this figure. The protective cover 14' further comprises a molded hinge 18' to allow opening and closing the protective cover 14', and a snap catch 17' to hold the protective covered 14' in the closed position.

The support structure 3' is bonded to the box container 2' with an annular ring of appropriate adhesive 8'. The support structure 3' also consists of a second container or vessel, (hereinafter "second vessel") that when the support structure 3' is bonded to the box container 2', will be internal to, though hermetically isolated from, the box container 2'. The box container 2' has an orifice 9' of appropriate size for the second vessel 6' to protrude into the box container 2'.

The second vessel 6' of the support structure 3' is filled with the desired material or fluid substance. In the present box container embodiment a dry powder is used and described. Following the filling of the second vessel 6' with the dry powder, the resilient material pushbutton 4' is snap-fitted to the support structure 3'. The snap fit is accomplished by an annular ridge 5' molded on the underside of the inside lip surface of the resilient material pushbutton 4'. The annular ridge 5' will snap into a corresponding annular recess 12' molded upon on the outer perimeter of the raised portion of the support structure 3'. The snap fit coupling between the annular ridge 5' and the annular recess 12' forms a seal to retain and hermetically seal the dry powder into the second vessel 6'. (The annular ridge 5' and the annular recess 12' are also shown in an exploded view in FIG. 9.) The support structure 3' and second vessel 6' are a single molded part wherein the second vessel 6' is attached to the support structure 3' by a paper-thin annular membrane ring 7' designed to be easily torn or separated to release the second vessel 6 into the material or liquid within the box container 2'.

Figure 9:
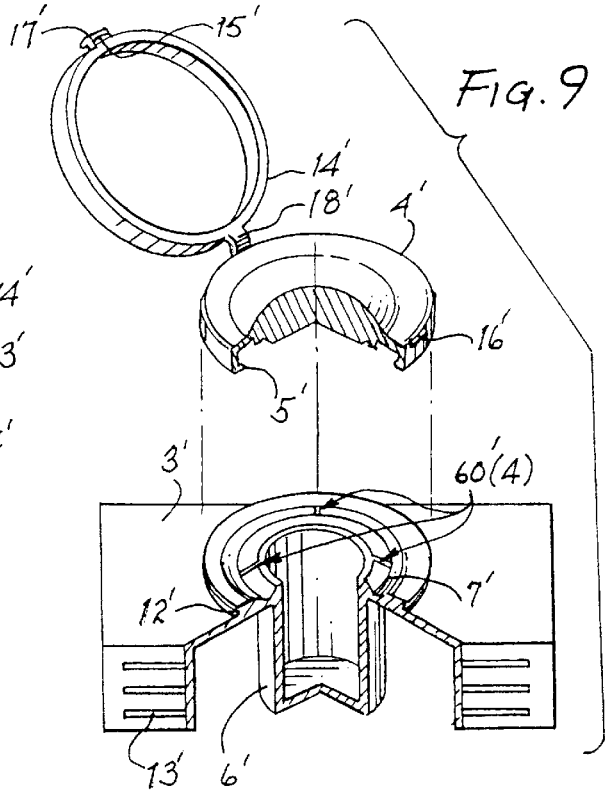
FIG. 9 shows a exploded view of the support structure, safety mechanism and pushbutton used with the box container embodiment.

Referring to FIG. 9, a simplified exploded view of the support structure, safety mechanism and pushbutton used with the box container embodiment is shown. Formed upon the upper surface of the edge of the second vessel 6' are a plurality of ribs 60', (four ribs in the present embodiment.) The ribs 60' rise above the surface of the edge of the second vessel 6 with the ends of the ribs 60' meeting the edge of the annular membrane ring 7' at a perpendicular angle. The ribs 60' function to cause stress or fracture points on the annular membrane ring 7' when the resilient material pushbutton 4' contacts and exerts force upon the plurality of ribs 60'.

The protective cover 14' further comprises a protruding snap catch 17' on the outside surface of the protective cover 14' lip which has an indent 15' that snap fits onto the protruding ridge 16' on the outside surface of the resilient material pushbutton 4' to keep the protective covered 14' closed. The protruding snap catch 17' also provides a gripping point to allow a finger to grasp the protective cover 14' to open it.

Figure 8:
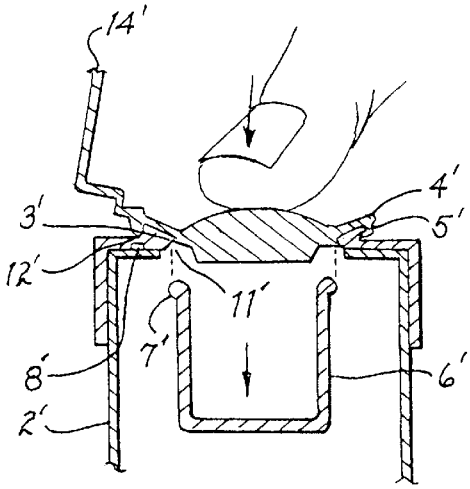
FIG. 8 shows a short-side cross-sectional view of the support structure used with the box container embodiment, featuring the second vessel and release mechanism after the release mechanism has been operated.

Referring to FIG. 8, a simplified short side cross-sectional view of the support structure 3' used with the box container embodiment is shown. This figure features the second vessel 6' and resilient material pushbutton 4' after the resilient material pushbutton 4' has been depressed for the operation of the present embodiment. (The protective cover 14' is in the raised or open position.) The resilient material pushbutton 4' includes an annular snap ring 11' formed as part of the resilient material pushbutton 4'. The annular snap ring 11' is sized to engage and lock into the orifice created when the annular membrane ring 7' fractures and separates allowing the second vessel 6' to be released into the box container 2'. The annular snap ring 11' will engage and lock into the orifice and form a seal at the annular membrane ring 7' fracture boundary. The seal formed when the annular snap ring 11' locks into the orifice created within the annular membrane ring 7' creates a second seal in the path leading along the resilient material pushbutton 4' from the interior of the box container 2' to the exterior of the box container 2'. The first seal is created between the annular ridge 5' molded on the underside of the inside lip surface of the resilient material pushbutton 4' and the corresponding annular recess 12' molded upon on the outer perimeter of the raise portion of the support structure 3'.

The second vessel 6', after its release from the annular membrane ring 7', moves into the main body of the box container 2', and the contents of box container 2' and the second vessel 6' are free to combine. The second vessel 6' also serves as an agitator to assist in the complete admixing of the different substances. In the present embodiment the two substances are a dry powder and a liquid, though those skilled in the art will recognize that many combinations of powders and/or fluids could be placed in the box container 2' and second vessel 6' and then admixed.

OPERATION

Bottle Embodiment Operation

The system 10 is designed to provide storage admixing and dispensing of materials or fluid substances. The present embodiment which includes a bottle container as shown and explained in FIGS. 1 though 5, holds a dry powder in the internal second vessel, and a liquid in the first vessel, which herein is a bottle. The operation of the system 10 is simple and straight forward to such a degree that instructions needed for a user will be minimal or non-existent.

The bottle 2 is filled with the desired liquid or powder. The support structure 3 is placed upon the top of the bottle 2 and screwed down until the annular elastomeric seal 26 contacts the upper rim of the neck of the bottle 2 and creates a seal. It should also be noted that the support structure 3 could be coupled to the bottle using other mechanical engagement designs or methods well known to those skilled in the art. One such method for example, would be a press-on design such as used by a traditional soda bottle and bottle cap use in which a bottle opener is required to access the bottle's contents.

The second vessel 6 is then filled with the desired powder or liquid and the resilient material pushbutton 4 is snapped onto the support structure 3. Those skilled in the art will recognize that the second vessel 6 could be filed first, and then the resilient material pushbutton 4 could be snapped onto the support structure 3, the bottle 2 would next be filled with the desired substance or material, and then the cap assembly 45 would be screwed onto the bottle 2.

Once distributed or shipped to the user, the bottle embodiment of the present invention features a safety mechanism to prevent accidental operation during shipping and handling. The safety mechanism operates as follows. Indicia consisting of three embossed arrows 31 on the resilient material pushbutton 4, and three embossed arrows 30 on the support structure 3 must be brought into alignment, arrow to arrow, in order for the safety mechanism to be defeated. The bottle 2 is gripped by the user with one hand, (not shown). The other hand (not shown ) is used to grip the resilient material pushbutton 4 which is then twisted approximately 60 degrees to bring the indicia into alignment.

The initial force required to rotate the resilient material pushbutton 4 is of a higher value due to the friction created by the retainer ridge 23 coupling into the retainer recess 25. After the rotation of the resilient material pushbutton 4 from the first position, continued rotation of the resilient material pushbutton 4 will relocate the tangs 24 from over the shallow grooves 22, to a second position over the deep notches 21. This second position is indicated by the alignment of the indicia consisting of the three embossed arrows 31 on the resilient material pushbutton 4, and the three embossed arrows 30 on the support structure 3.

The positioning of the resilient material pushbutton 4 to the second position will allow the user to depress the resilient material pushbutton 4 with a finger. The resilient material pushbutton 4 will flex into the support structure 3, causing the transfer of the force upon the resilient material pushbutton 4 to the ribs 60 which will in turn transfer the force to the annular membrane ring 7. The application of force upon the annular membrane ring 7 will cause it to separate or tear completely. This separation of the annular membrane ring 7 will cause the second vessel 6 to be released into the main body of the bottle 2. The continuation of the application of force upon the resilient material pushbutton 4 will cause the snap ring 11 to snap into and lock into an orifice created when the second vessel 6 is separated from the annular membrane ring 7. The coupling of the snap ring 11 into the orifice within the annular membrane ring 7 will create a seal to aid in ensuring that the contents of the bottle 2 cannot leak out. Additionally, with the resilient material pushbutton 4 locked into the orifice, the reverse rotation of the resilient material pushbutton 4 which would cause the three embossed arrows 31 on the resilient material pushbutton 4, to become non-aligned with the three embossed arrow 30 on the support structure 3 is not possible, thereby providing a safety indication that the present invention has either been used or tampered with.

Two seals will exist to prevent a leakage past the resilient material pushbutton 4. The first seal is where the resilient material pushbutton 4 couples to the support structure 3 and the seal is effectuated between the annular ridge 5 and the annular recess 12. The coupling of the snap ring 11 into the orifice within the annular membrane ring 7 will create the second seal to aid in ensuring that the contents of the bottle 2 cannot leak outpast the resilient material pushbutton 4. With the second vessel 6 now within the body of the bottle 2, the contents of the bottle 2 and the second vessel 6 will be free to be admixed together. The user now shakes the bottle 2 to admix the contents thoroughly together. The second vessel 6 acts as an agitator within the bottle 2 and aids in the admixing of the materials together.

To dispense the admixture, the user may uncouple the cap assembly 45 from the bottle 2 by unscrewing the cap assembly 45 from the bottle 2 and then dispensing the admixed material. The thin flexible annular flange 20 that circumscribes the outside circumference of the second vessel 6 will prevent the second vessel 6 from flowing out the neck of the bottle as its circumference is larger than the inner diameter of the neck of the bottle opening 9.

Referring to FIG. 5, an alternate embodiment of the resilient material pushbutton 4 of the system 10 is shown. The operation of the system 10 with this alternate embodiment remains identical to the previous discussion except as follows: Following the admixing of the substances, a common drinking straw is inserted into the straw access 40 in the resilient material pushbutton 4. The end of the drinking straw will penetrate the thin frangible membrane 41 coupled to the bottom end of the straw access 40. The frangible membrane 41 has grooved tear lines 42 in a cross-hair pattern that will be easily fractured by the drinking straw inserted into the straw access 40. The admixture within the bottle 2 may now be dispensed using the drinking straw in the normal manner.

Box Container Embodiment Operation

The operation of the system 10' featuring the box container embodiment is similar to the bottle embodiment with the following differences. The support structure 3' is bonded to the box container 2' during the manufacturing process rather than being screwed to the bottle 2 (FIG. 1). The filing of the box container may be performed at any time after the box container 2' is capable of holding the desired substance. As previously explained, the second vessel 6' may be filled after the support structure is coupled to the box container 2', or prior to coupling the support structure to the box container 2'.

Once distributed or shipped to the user, the box container embodiment of the present invention features a safety mechanism to prevent accidental operation during shipping and handling. To release the safety mechanism the user will grip the box container 2' by the two ribbed structural enhanced sides 13', formed into the support structure 3' on the sides. The hinged protective cover 14' is snapped up using a finger or thumb (not shown) upon the protruding snap catch 17' to free the indent 15' from the protruding ridge 16'. With the hinged protective cover 14' in the raised or open position, this will expose the resilient material pushbutton 4'.

Releasing the safety mechanism will allow the user to depress the resilient material pushbutton 4'. The resilient material pushbutton 4' will flex into the support structure 3', causing the transfer of the force upon the resilient material pushbutton 4' to the ribs 60' which will in turn transfer the force to the annular membrane ring 7'. The application of force upon the annular membrane ring 7' will cause it to separate or tear completely. This separation of the annular membrane ring 7' will cause the second vessel 6' to be released into the main body of the box container 2'. The continuation of the application of force upon the resilient material pushbutton 4' will cause the snap ring 11' to snap into and lock into an orifice created when the second vessel 6' is separated from the annular membrane ring 7'. The coupling of the snap ring 11' into the orifice within the annular membrane ring 7' will create a seal to aid in ensuring that the contents of the box container 2' cannot leak out past the resilient material pushbutton 4'.

Two seals will exist to prevent a leakage past the resilient material pushbutton 4'. The first seal is where the resilient material pushbutton 4' couples to the support structure 3 and the seal is effectuated between the annular ridge 5' and the annular recess 12'. The coupling of the snap ring 11' into the orifice within the annular membrane ring 7' will create the second seal to aid in ensuring that the contents of the box container 2' cannot leak out. With the second vessel 6' now within the body of the box container 2', the contents of the box container 2' and the second vessel 6' will be free to be admixed together. The user now shakes the box container 2' to admix the contents thoroughly together. The second vessel 6' acts as an agitator within the box container 2' and aids in the admixing of the materials together.

To dispense the admixture within the box container 2, (Referring to FIG. 6) as is well known in the art of drinking dispensers and containers, a common drinking straw may be used to pierce a common drinking straw hole 50' placed upon the box container 2'. In the box container embodiment, the drinking straw hole 50' is placed upon the upper end of the box container 2'. Those skilled in the art will recognize that the drinking straw hold 50' could be placed in many locations.

Additionally, in an alternate embodiment of the box container (referring to FIG. 6) as has been previously described under the operation of the Bottle Embodiment Operation section, another method of dispensing the admixture is as follows. The resilient material pushbutton 4 possesses a straw access 40. Following the admixing of the substances, a common drinking straw is inserted into the straw access 40 in the resilient material pushbutton 4. The end of the drinking straw will penetrate the thin frangible membrane 41 coupled to the bottom end of the straw access 40. The frangible membrane 41 has grooved tear lines 42 in a cross-hair pattern that will be easily fractured by the drinking straw inserted into the straw access 40. The admixture within the box container 2' (FIG. 6) may now be dispensed using the drinking straw in the normal manner.

It should be noted that, although not explicitly described or discussed above, those well skilled in the art will recognize that the tang and groove safety mechanism, and the hinged protective cover safety mechanism may be used on either the bottle or the box container embodiments as additional embodiments of the present invention.

Furthermore, even though the present invention is ideally suited for food admixtures, or medicinal admixtures, additional uses of the present invention include any usage where two substances, powder or liquid, must remain unmixed until just prior to usage due to aging, chemical reactions etc. Thus the end use of the present invention has broad application including substances for consumption, medicinal usage, and industrial or manufacturing usage, and the idea is also readily adaptable to many different sizes and shapes of both first and second vessels of varying design and construction.

Although the invention has been particularly shown and described with reference to a preferred embodiment thereof, it will be understood by those skilled in the art that changes in form and detail may be made therein without departing from the spirit and scope of the invention.

What is claimed is:

1. A storage, admixing, and dispensing system, comprising, in combination:

a first vessel for retaining a first substance;

a support structure coupled to the first vessel;

a second vessel coupled to the support structure for containing a second substance;

a release mechanism coupled to the support structure for releasing the second vessel from the support structure for combining the first substance with the second substance; wherein the release mechanism comprises a resilient material pushbutton;

a safety mechanism coupled to the resilient material pushbutton for preventing accidental operation of the release mechanism;

wherein the second vessel is internal to and retained within the first vessel;

wherein the release mechanism completely releases the second vessel from the support structure for combining the first substance with the second substance;

wherein the safety mechanism comprises:

a hinged protective cover;

a protruding snap cap coupled to the hinged protective cover;

a indent coupled to the protruding snap cap;

a protruding ridge coupled to the indent when in a closed position; and wherein the hinged protective cover has an open position and a closed position and wherein the open position exposes the resilient material pushbutton for allowing the depression of the resilient material pushbutton for activating the release mechanism and wherein the closed position covers the resilient material pushbutton for preventing depression thereof.

2. The system of claim 1 further comprising a frangible annular ring membrane coupled to the second vessel for coupling the support structure to the second vessel.

3. The system of claim 2 wherein the frangible annular ring membrane is a hermetic seal between the first vessel and the second vessel.

4. The system of claim 3 wherein the second vessel has a plurality of ribs located on an edge of the second vessel for aiding in the tearing of the annular ring membrane upon the depression of the resilient material pushbutton.

5. The system of claim 1 wherein the second vessel is an agitator for combining the first substance and the second substance within the first vessel when released.

6. The system of claim 5 wherein the first substance and the second substance form a admixture when combined.

7. The system of claim 6 wherein the first vessel is a dispensing apparatus for dispensing the admixture.

8. The system of claim 1 wherein the resilient material pushbutton further comprises a straw sized opening.

9. The system of claim 8 wherein the straw sized opening further comprises a frangible membrane for sealing the straw sized opening and which is penetrable by a drinking straw for allowing the admixture to be dispensed.

10. The system of claim 1 wherein the support structure further comprises an orifice created when the second vessel is released wherein the orifice is for holding the resilient material pushbutton in a depressed state.

11. The system of claim 10 wherein the resilient material pushbutton further comprises an annular ridge for locking into the orifice and retaining the resilient material pushbutton in a depressed position for indicating the release mechanism has been operated.

12. The system of claim 11 wherein the annular ridge locking into the orifice forms a seal between the first vessel and a external environment.

13. The system of claim 1 wherein the resilient material pushbutton provides at least one seal for the first vessel and at least one seal for the second vessel.

14. The system of claim 1 wherein the first vessel is a box container.

15. The system of claim 14 wherein the support structure and the resilient material pushbutton forms a mechanism to seal the box container.

16. The system of claim 15 wherein the mechanism allows the admixture to be dispensed from the box container.

17. A storage, admixing, and dispensing system, comprising, in combination:

a first vessel for retaining a first substance wherein the first vessel is a dispensing apparatus for dispensing the admixture;

a support structure coupled to the first vessel wherein the first vessel is a box container, and the support structure is bonded to the first vessel;

a second vessel coupled to the support structure for containing a second substance and wherein the second vessel is internal to and retained within the first vessel and is an agitator for combining the first substance and the second substance within the first vessel, the first substance and the second substance form a admixture when combined; and a release mechanism coupled to the support structure for releasing the second vessel from the support structure for combining the first substance with the second substance, the release mechanism comprising:

a resilient material pushbutton which seals the second vessel; and a safety mechanism coupled to the support structure for preventing accidental operation of the release mechanism, the safety mechanism having an open position and a closed position wherein the open position exposes the resilient material pushbutton for allowing the depression of the resilient material pushbutton for activating the release mechanism and the closed position covers the resilient material pushbutton for preventing depression thereof;

a frangible annular ring membrane coupled to the second vessel for coupling the support structure to the second vessel wherein the frangible annular ring membrane is a hermetic seal between the first vessel and the second vessel;

a plurality of ribs located on an edge of the second vessel for aiding in the tearing of the annular ring membrane upon the depression of the resilient material pushbutton; and a straw sized opening formed within the resilient material pushbutton and wherein the straw sized opening has a frangible membrane for sealing the straw sized opening and which is penetrable by a drinking straw for allowing the admixture to be dispensed.

18. The system of claim 17 wherein the support structure further comprises an orifice created when the second vessels released for holding the resilient material pushbutton.

19. The system of claim 18 wherein the resilient material pushbutton further comprises an annular ridge for locking into the orifice and retaining the resilient material pushbutton in a depressed position for indicating the release mechanism has been operated.

* * * * *